United States Patent [19]

Kincheloe

[11] Patent Number: 5,000,327

[45] Date of Patent: Mar. 19, 1991

[54] WRITING ARTICLE AND HOLDER SYSTEM FOR WET ENVIRONMENT

[76] Inventor: Allen C. Kincheloe, 12110 Murphy Rd., Stafford, Tex. 77477

[21] Appl. No.: 572,412

[22] Filed: Aug. 27, 1990

[51] Int. Cl.[5] ..... A47F 7/00; A47B 63/00

[52] U.S. Cl. ..... 211/88; 211/88; 211/69.5; 248/206.4; 206/232; 281/45; 401/52

[58] Field of Search ..... 281/44, 45, 30, 25; 248/205.5, 206.3, 205.3, 206.4; 211/69.1, 69.5, 87, 88; 206/224, 232; 401/195, 52

[56] References Cited

U.S. PATENT DOCUMENTS

| | | | |
|---|---|---|---|
| 1,560,493 | 11/1925 | Steinberg | 211/69.1 |
| 1,739,801 | 12/1929 | Pitts | 248/206.3 |
| 1,955,736 | 4/1934 | Claytor | 211/88 |
| 2,573,176 | 10/1951 | Blackstone | 281/44 |
| 2,751,112 | 6/1956 | Bierwert | 281/45 X |
| 2,979,120 | 4/1961 | Amburn | 211/88 X |
| 3,570,677 | 3/1971 | George | 211/88 |
| 4,100,684 | 7/1978 | Berger | 211/88 |

*Primary Examiner*—Richard J. Johnson
*Attorney, Agent, or Firm*—James L. Jackson

[57] ABSTRACT

A writing system is provided for use in both dry and wet environments and includes a holder adapted to be releasably supported by a wall surface and defining pen and note pad receptacles. The holder forms a perforate bottom wall permitting drainage of water from the receptacles. One receptacle supports a waterproof pen. The other receptacle receives a waterproof note pad composed of waterproof sheet material such as Tyvek paper-like material which are bound in assembly to form a note pad. To facilitate all weather use of written materials and writing materials, water-proof paper-like materials is employed on which is printed information with water-proof ink and/or written information with a water-proof writing instrument.

14 Claims, 1 Drawing Sheet

FIG. 1
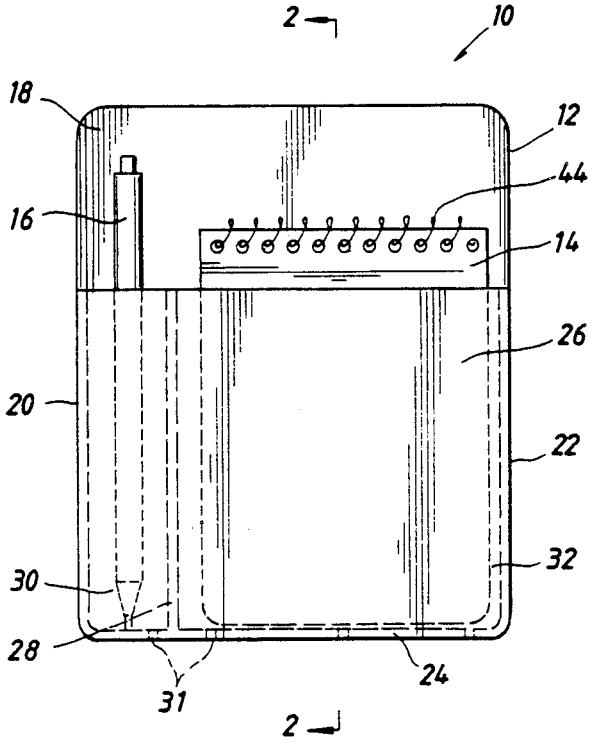
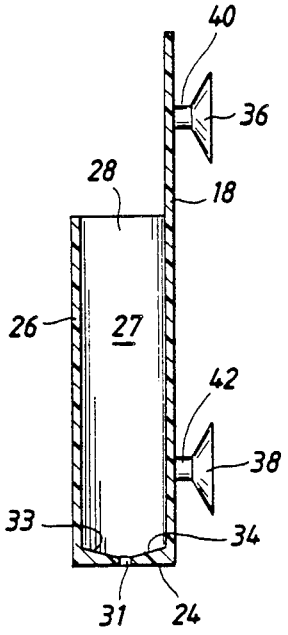
FIG. 2
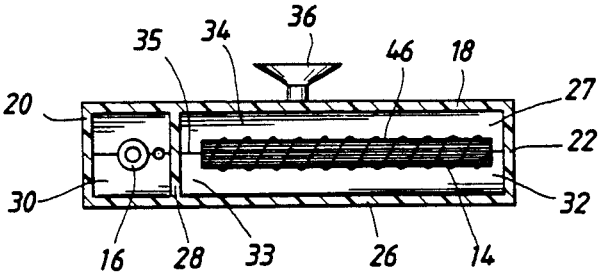
FIG. 3

WRITING ARTICLE AND HOLDER SYSTEM FOR WET ENVIRONMENT

FIELD OF THE INVENTION

This invention relates generally to writing articles such as paper pads, pencils, pens, etc. and a holder device therefor. More specifically, this invention is directed to a writing system for use specifically in a wet environment and which employs water-proof writing sheets, a waterproof writing instrument and a holding device therefor which is intended for mounting on a vertical surface, such as a wall of a wet environment, such as a shower or bath. Even more specifically, this invention also concerns the provision of water-proof sheets and a water-proof writing instrument to facilitate written information on the water-proof sheets which will remain legible under circumstances where water is permitted to come into contact with the sheets.

BACKGROUND OF THE INVENTION

It is well known that thoughts and ideas come to mind during periods when the mind is relaxed and is not involved in concentration on specific tasks. For example, ideas often come to persons when they are sleeping or resting. When these ideas come, it is desirable to have immediate access to a writing instrument and writing paper in order that these thoughts may be subsequently remembered and placed into action For this reason, many persons who are involved in business maintain a pencil or pen and a pad of paper at a bedside table for immediate access when these ideas come to mind. Also, it is well known that ideas often come to mind while a person is involved with various aspects of personal hYgiene, such as while taking a shower or a bath, while shaving, etc. It is desirable, therefore, to have immediate access to writing materials in the bathroom environment, but such is typically not done because of the presence of water. If kept in a bathroom environment, therefore, such writing materials are typically stored inside a drawer or cabinet so as to be protected from contact by water. In such case, however, these writing materials are not readily available for use when needed. Further, because the person's hands may be wet when a novel idea comes to mind, writing the idea on paper is typically deferred until a more convenient time. Often, these thoughts are of rather fleeting nature and so the person, involved in other tasks, fails to write them down and ultimately loses the value of the thought. It is desirable, therefore, to provide a writing system that may be utilized under wet conditions and which is readily available for immediate use, even under circumstances where the person's hands are wet or when large quantities of water are present and can come into contact with the writing instrument and writing materials.

It has also been the practice to place note pads at or near the entry door of a home so that visitors may write notes to the home owner when the home owner is away. These pads are typically located in a protective enclosure to protect the paper from moisture. A pencil or other writing instrument is typically located in the enclosure and may be attached to the enclosure by a string, bead chain, etc. Various types of paper, polymer materials or combined paper and polymer materials are often employed under circumstances where these materials might come into contact with water For example, labels, shipping tags, temporary license plates, parking violation tickets, mail delivery notices and sheet material of like nature are often printed with data. Should these materials come into contact with water, such as during rain or become wet with dew or fog, the written material can become illegible. Polymer coated paper is often employed to protect the written or printed matter. Further, under circumstances where paper is used and the paper is intended to be written upon and located in an environment that may become wet, protective enclosures or packets are often employed to protect the paper from becoming wet. These protective packets are often composed of various water-proof polymer materials. It is desirable, therefore, to provide a paper or paper-like material that is of water-proof nature and to provide a writing instrument which may be employed to write information on the paper even when the paper is wet so that the paper will not be destroyed or deteriorate when it becomes wet and the written information will remain legible on the paper even when the paper becomes wet. It is desirable, therefore, to provide a paper-like material which is of water-proof nature and to provide a water-proof writing instrument that may be employed to place permanent written information on the water-proof paper even when the paper is wet so that both the paper and the written information will remain in good condition even when wet.

PRIOR ART

Paper receptacles which are intended for temporary wall mounting have been developed as taught by U.S. Pat. No. 1,739,801 of Pitts which discloses a holding device for paper articles such as advertisements. U.S. Pat. No. 3,123,935 of Williams discloses a clip-board device for retaining paper and for retaining a writing instrument. U.S. Pat. No. 4,100,684 of Berger discloses a holding device having a compartment for paper and a compartment for a writing instrument. The holder device of Berger is also intended for temporary wall mounting. U.S. Pat. No 4,472,843 of Chermak discloses a bathtub accessory holder which may be used for writing by a person seated in the bath tub.

From the standpoint of writing instruments, it is known that certain ball-point pens have been developed which have the capability of writing on paper in wet conditions such as when the paper or an acceptable substrate is located in water. Further, a waterproof pen is reported to be manufactured by the Fisher pen company of Forest Park Ill.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

In the Drawings

FIG. 1 is an elevational view of a waterproof writing system constructed in accordance with the present invention and incorporating a waterproof pen, a waterproof note pad and a wall mountable holder device, each of these components capable of use in wet conditions.

FIG. 2 is a sectional view taken along line 2—2 of FIG. 1.

FIG. 3 is a plan view of the apparatus of FIGS. 1 and 2.

DETAILED DESCRIPTION OF PREFERRED EMBODIMENT

Referring now to the drawings and first to FIG. 1, a waterproof writing system for use in wet environments is illustrated generally at 10 and includes a note and pen holder device 12, a waterproof writing pad 14 and a waterproof pen 16 which are each adapted to be used in wet conditions. The pen and pad holder device 12 incorporates a substantially planar rear wall 18 to which is integrally formed or otherwise suitably connected opposed side walls 20 and 22 and a bottom wall 24. A front wall 26 is formed integral with or otherwise connected to the side walls and bottom wall and cooperates therewith to form a generally rectangular compartment 27. The side walls and front wall are of less height than the height of the rear wall 18 so that the rear wall projects well above the rectangular compartment 27. A vertically oriented partition 28 is also formed integrally with or connected to, the front and rear walls 26 and 18 and the bottom wall 24 and thus separates the rectangular compartment into a pen receptacle 30 and a writing pad receptacle 32. Each of the receptacles 30 and 32 is preferably of generally rectangular configuration and are of appropriate dimensions to contain the waterproof pen 16 and the waterproof pad 14, respectively, so that the upper portions thereof are exposed to facilitate ease of removal from their respective receptacles when desired. The receptacles, however, may be of any other suitable configuration as desired.

The bottom wall 24 of the holder device 12 is provided with a plurality of drain openings 31, at least one of the openings being located at the bottom of the pen receptacle 30. Water that becomes deposited in either of the receptacles 30 and 32 therefore, will drain from the compartments via the drain openings 31. To facilitate efficient drainage of water from the receptacles 30 and 32, the bottom wall 24 may form a trough-like configuration to direct water to the drain openings 31. In one suitable form of the invention the bottom wall 24 may define internal tapered opposed surfaces 33 and 34 that converge to define a line of intersection 35 that is the center of the longitudinal bottom wall. This feature assists in directing any water present in the receptacles 30 and 32 toward the drain openings 31.

As shown particularly in FIGS. 1–3, the pen and pad holder 12 are intended for temporary mounting for support on a suitable wall structure, such as the wall of a shower or bath. As such, the rear wall 18 may be provided with one or more temporary mounting devices such as the resilient suction cups 36 and 38, of FIGS. 2 and 3, which are received by connector elements 40 and 42 which project rearwardly from the rear wall 18. The suction cups 36 and 38 are composed of any suitable resilient materials such as rubber or any one of a number of suitable flexible polymer materials. When applied to a smooth wall surface such as the porcelain or polymer wall surface of a bathroom facility, the suction cups will adhere to the wall surface and provide adequate temporary support for the holder device 12 and its contents. The holder device may also be attached to the wall structure in any other suitable manner such as by means of adhesive, or by means of Velcro fastening material, etc. It is only necessary that the support system for the holder device be capable of withstanding the effects of water so as to provide temporary support for the holder. This feature permits the user to quickly and efficiently place the holder device on a wall surface at a desired location. Also, the user may quickly and efficiently move the holder device to any other location that should become more desirable.

The holder device, as shown in FIGS. 1–3, is of a simple design that may be readily molded from any one of a number of suitable polymer materials which are capable of efficiently withstanding the effects of water. Alternatively, the holder device may be composed of any other suitable materials such as rubber or metal. For example, the holder device maY be composed of sheet metal materials such as aluminum or stainless steel without departing from the spirit or scope of this invention.

For purposes of facilitating the waterproof system features of this invention, the waterproof pen 16 will be of any suitable character that renders it capable of being repeatedly wetted or wet for extended periods of time while retaining the capability of placing substantially permanent markings on a suitable paper-like substrate. Accordingly, a waterproof pen such as that currently marketed by the Fisher Pen Company of 743 Circle Avenue, Forest Park, Ill. 60130 may be effectively employed within the spirit and scope of this invention.

Obviously, ordinary paper that is employed to make up the writing pad 14 would deteriorate in a short period of time upon contact by water. Accordingly, the note pad 14 is composed of sheets of waterproof paper-like substrate which will accept the waterproof ink of the pen 16 and which will not deteriorate even when frequently wetted by water or when completely immersed in water. According to the present invention it has been determined that Tyvek paper-like material will function quite readily as the substrate or sheets of a waterproof note pad. If desired, the note pad sheets may be retained in assembly by means of a spiral binder element 44 as shown in FIGS. 1 and 2 and may incorporate a backing sheet 46 of rather rigid, waterproof materials such as any one of a number of suitable polymer materials to provide sufficient rigidity that the waterproof note pad may be held in the hand of the user and utilized down to the last sheet for writing notes. Alternatively, the substrates or sheets of the note pad 14 may be connected in assembly by means of a strip of waterproof glue at the upper portion or by means of a polymer backing. The Tyvek paper from which the pad 14 is composed is capable of being completely immersed in water for extended periods of time without any significant deterioration. Tyvek paper is ordinarily employed as envelope material because of its extremely tough character and because it is waterproof. It has also been determined that Tyvek paper is capable of being lined with permanent ink so that notations written on the paper can be neatly organized.

A holder device such as that shown in FIG. 1, together with its waterproof pen 16 and waterproof pad 14 may be temporarily mounted on any suitable wall so as to be of immediate access for use by persons in a shower, a bathroom facility, or in other areas where large volumes of water might be present. The pen and pad may be utilized even when completely wet for the purpose of jotting down notations and thus capturing ideas that might otherwise be lost. Although the holder device 12 is designed with drain openings 31 to permit drainage of any water that is deposited within the receptacles 30 and 32, it should be born in mind that the note pad 14 may be written upon by the pen 16 even under circumstances where the pad and pen are completely wet. It is clear, therefore, that I have provided a system providing users with the unique capability of making mental notations under circumstances where such notations are ordinarily unavailable.

In view of the foregoing, it is evident that the present invention is one well adapted to attain all of the objects and features hereinabove set forth, together with other objects and features which are inherent in the apparatus disclosed herein.

As will be readily apparent to those skilled in the art, the present invention may be produced in other specific forms without departing from its spirit or essential characteristics. The present embodiment, is therefore, to be considered as illustrative and not restrictive, the scope of the invention being indicated by the claims rather than the foregoing description, and all changes which come within the meaning and range of the equivalence of the claims are therefore intended to be embraced therein.

What is claimed is:

1. A writing system for use in environments that may become wet, comprising:

(a) a holder adapted to be releasable supported by a wall surface and forming upwardly opening note pad and pen receptacles, said holder having drain means for draining water from each of said note pad and pen receptacles;

(b) a waterproof writing instrument being positioned within said pen receptacle and capable of marking on paper and paper-like sheet material whether dry or in the presence of water;

(c) a waterproof note pad being positioned within said note pad receptacle and including a plurality of bound sheets composed of waterproof paper-like material capable of receiving markings of said waterproof writing instrument when said paper-like material is both dry and wet; and (d) means for releasably supporting said holder on a wall surface.

2. The writing system of claim 1, wherein:

(a) said holder comprises interconnected front, rear, side and bottom walls forming an open ended, generally rectangular compartment; and (b) a partition interconnecting said front, rear and bottom walls and separating said compartment into said pen and note pad receptacles.

3. The writing system of claim 1, wherein:

said front and side walls and said partition are of less height than the vertical dimension of said waterproof writing instrument and said waterproof note pad such that the upper ends of the same are exposed for manual grasping and removal from the holder.

4. The writing system of claim 2 wherein:

said rear wall is of greater height than said front wall, said side walls and said partition and of greater height than the vertical dimension of said waterproof writing instrument and said waterproof note pad.

5. The writing system of claim 2, wherein:

(a) said bottom wall is internally tapered from each side to form an elongate water drainage trough having a center line; and (b) said drain means being drain openings in said bottom wall arranged along said center line, at least one of said drain openings being formed in the portion of said bottom wall defining the bottom of said pen receptacle.

6. The writing system of claim 1, wherein said means for releasably supporting said holder comprises suction cup means being connected with said rear wall and adapted for suction retention with a wall surface for support of said holder on said wall surface.

7. The writing system of claim 1, wherein said waterproof note pad comprises:

(a) a plurality of sheets of waterproof paper-like material; and (b) means for retaining said plurality of sheets in assembly.

8. The writing system of claim 7, wherein:

said plurality of sheets of waterproof paper-like material comprise Tyvek paper-like material.

9. A writing system for use in both dry and wet environments, comprising:

(a) a holder having front, rear, side and bottom walls forming an upwardly opening receptacle, said holder having an internal partition separating said compartment into pen and note pad receptacles, said front, and side walls and said partition establishing a predetermined height, said rear wall exceeding said predetermined height;

(b) a waterproof writing instrument being removably positioned within said pen receptacle and when positioned vertically, having a vertical dimension exceeding said predetermined dimension, said waterproof writing instrument capable of marking on paper and paper-like sheet material when both the paper and the writing instrument are wet and dry;

(c) a waterproof note pad composed of a plurality of sheets of waterproof paper-like material which sheets are bound together to form a pad, said waterproof paper-like material capable of receiving markings of said waterproof writing instruments both when said paper-like material is dry and wet; and (d) means on said rear wall of said holder for releasably supporting said holder from a wall surface.

10. The writing system of claim 9, wherein said means for releasably supporting said holder from a wall surface comprises at least one suction cup device projecting from said rear wall and disposed for establishment of supporting engagement with a wall surface.

11. The writing system of claim 9, wherein said waterproof paper-like material comprises sheets of Tyvek material forming said pad.

12. The writing system of claim 11, wherein:

said sheets of waterproof paper-like material are lined with permanent waterproof ink to form a lined note pad.

13. The writing system of claim 9, wherein:

said bottom wall defines oppositely tapered substantially planar surfaces forming a downwardly converging trough for directing water centrally thereof, said drain means being a plurality of holes formed along the line of intersection of said oppositely tapered planar surfaces, at least one of said drain holes being formed in that portion of said bottom wall that forms the bottom of said pen receptacle.

14. A holder adapted to be releasably supported by a wall surface, comprising:

(a) front, rear, side and bottom walls being interconnected to form a generally rectangular compartment, said front and side walls establishing a predetermined height of said compartment;

(b) a partition interconnecting said front, rear and bottom wall and separating said compartment into a pen receptacle and a note pad receptacle;

(c) said rear wall being of greater height than said predetermined height;

(d) said bottom wall forming a plurality of drain openings and defining opposed substantially planar tapered surfaces interconnecting along a centerline and forming a trough for conducting water to said drain openings, said drain openings being located along said centerline, at least one of said drain openings being located in that portion of said bottom wall forming the bottom of said pen receptacle; and (e) means on said rear wall for releasably supporting said holder from a wall surface.

* * * * *